US010045125B2

(12) United States Patent
Rusconi Clerici Beltrami et al.

(10) Patent No.: US 10,045,125 B2
(45) Date of Patent: Aug. 7, 2018

(54) MICRO-ELECTROMECHANICAL SOUND TRANSDUCER WITH SOUND ENERGY-REFLECTING INTERLAYER

(71) Applicant: USound GmbH, Graz (AT)

(72) Inventors: Andrea Rusconi Clerici Beltrami, Vienna (AT); Ferruccio Bottoni, Graz (AT)

(73) Assignee: USound GmbH, Graz (AT)

( * ) Notice: Subject to any disclaimer, the term of this patent is extended or adjusted under 35 U.S.C. 154(b) by 0 days.

(21) Appl. No.: 15/107,371

(22) PCT Filed: Dec. 17, 2014

(86) PCT No.: PCT/EP2014/078220
§ 371 (c)(1),
(2) Date: Jun. 22, 2016

(87) PCT Pub. No.: WO2015/097035
PCT Pub. Date: Jul. 2, 2015

(65) Prior Publication Data

US 2017/0006381 A1 Jan. 5, 2017

(30) Foreign Application Priority Data

Dec. 23, 2013 (DE) ..... 10 2013 114 826

(51) Int. Cl.
*H04R 25/00* (2006.01)
*H04R 7/10* (2006.01)
(Continued)

(52) U.S. Cl.
CPC ..... *H04R 7/10* (2013.01); *H04R 3/00* (2013.01); *H04R 17/00* (2013.01); *H04R 17/005* (2013.01);
(Continued)

(58) Field of Classification Search
CPC . H04R 7/10; H04R 3/00; H04R 17/00; H04R 17/005; H04R 2201/003; H04R 2400/01
(Continued)

(56) References Cited

U.S. PATENT DOCUMENTS 4,861,420 A 8/1989 Knutti et al.
5,650,685 A 7/1997 Kosinski et al.
(Continued)

FOREIGN PATENT DOCUMENTS

DE 102005008512 8/2006
DE 102005008514 8/2006
DE 102009002986 11/2010

OTHER PUBLICATIONS

German Search Report for Application No. 102013114826.3, dated Sep. 16, 2014 (machine translation).
(Continued)

*Primary Examiner* — Sean H Nguyen
(74) *Attorney, Agent, or Firm* — JK Intellectual Property Law, PA

(57) ABSTRACT

A MEMS sound transducer for at least one of generating and detecting sound waves in air in an audible wavelength spectrum includes a carrier substrate, a cavity defined in the carrier substrate, the cavity defining at least one opening, and a multilayered piezoelectric membrane structure spanning over the opening of the cavity and having an edge area connected with the carrier substrate so that with respect to the carrier substrate the membrane structure is capable of vibrating to at least one of generate and/or and detect sound energy, wherein the membrane structure has in cross-section at least in some areas a first piezo layer spaced from a second piezo layer. An interlayer is arranged in an area between the first and second piezo layers, the interlayer being made of at least one of silicon oxide, silicon nitride and polysilicon, the interlayer being configured so that sound energy can be
(Continued)

reflected in the direction of at least one interface of the membrane structure adjacent to the air.

19 Claims, 9 Drawing Sheets

(51) Int. Cl.
*H04R 17/00* (2006.01)
*H04R 3/00* (2006.01)

(52) U.S. Cl.
CPC .... *H04R 2201/003* (2013.01); *H04R 2400/01* (2013.01)

(58) Field of Classification Search
USPC ..... 381/173
See application file for complete search history.

(56) References Cited

U.S. PATENT DOCUMENTS 6,243,474 B1 * 6/2001 Tai ..... H04R 19/016 29/594
2008/0149832 A1 6/2008 Zorn
2008/0247585 A1 10/2008 Leidl et al.
2011/0075867 A1 3/2011 Chung et al.
2011/0120843 A1 5/2011 Wunnicke et al.
2011/0148255 A1 6/2011 Nihei
2012/0082325 A1 * 4/2012 Sakurauchi ..... B81C 1/00666 381/174
2013/0051587 A1 2/2013 Stephanou et al.
2013/0307375 A1 11/2013 Udayakumar et al.
2013/0329920 A1 12/2013 Grosh et al.

OTHER PUBLICATIONS

Abstract—ES Kim; "Piezoelectric MEMS for audio Signal Transduction, Microfluidic management, resonant mass sensing, and movable surface micromachined structures", Ultrasonics Symposium, 2008; IUS 2008, IEEE, Piscataway, NJ, USA; Nov. 2, 2008, pp. 924-929.
Abstract—ES Kim, et al, "Piezoelectric bimorph microphone built on micromachined Parylene Diaphragm", Journal of Microelectromechanical Systems, vol. 12, No. 6, Dec. 1, 2003, pp. 892-898.
Abstract—Zhang, et al., "A Novel Pressure Microsensor with 30—Thick Diaphragm and Meander-Shaped Piezoresistors Partially Distributed on High-Stress Bulk Silicon Region", IEEE Sensors Journal, vol. 7, No. 12, Dec. 1, 2007; pp. 1742-1748.
International Search Report for PCT/EP2014/078220, dated Mar. 4, 2016.
International Preliminary Report on Patentability (English translation), dated Jun. 28, 2016.
German Office Action, for Application No. 14 820 823.4, dated Mar. 1, 2018, and English Machine Translation.
Search Report Issued by the Intellectual Property Office of Singapore, dated Aug. 17, 2017.

* cited by examiner

MICRO-ELECTROMECHANICAL SOUND TRANSDUCER WITH SOUND ENERGY-REFLECTING INTERLAYER

CROSS-REFERENCE TO RELATED APPLICATIONS

This application is a national stage of International Application No. PCT/EP2014/078220, filed Dec. 17, 2014 and claims benefit to German Patent Application No. 10 2013 114 826.3 filed Dec. 23, 2013, both of which are incorporated by reference herein.

TECHNICAL FIELD

The present disclosure relates to a Micro-Electromechanical Systems (MEMS) sound transducer to generate and/or detect sound waves in the audible wavelength spectrum with a carrier substrate, a cavity developed in the carrier substrate with at least one opening, and a multilayered piezoelectric membrane structure, which spans the cavity opening and whose edge area is connected to the carrier substrate so that with respect to the carrier substrate, it is capable of vibrating to generate and/or detect sound energy, wherein the membrane structure comprises a first and second piezo layer in cross section, at least in some areas.

Furthermore, the disclosure relates to a chip, especially a silicon chip, to generate and/or detect sound waves in the audible wavelength spectrum with several MEMS sound transducers arranged together in array-like fashion and/or separately controlled from one another

BACKGROUND

As noted, the abbreviation "MEMS" stands for micro electro-mechanical systems. MEMS sound transducers can be developed as microphones and/or loudspeakers. Sound is generated or detected by a MEMS sound transducer membrane mounted in a way so that it can vibrate. Piezoelectric actuating elements can make the membrane vibrate to generate a sound wave. As a rule, such a micro loudspeaker must generate considerable air volume displacement to achieve a significant sound pressure level. Such a micro loudspeaker is known, for example, from DE 10 2012 220 819 A1.

Alternatively, however, the MEMS sound transducer can also be developed as a microphone, in which case the membrane's acoustic stimulation is transformed into electrical signals via the piezoelectric elements. Such a MEMS microphone is known, for example, from DE 10 2005 008 511 A1.

SUMMARY

The task of the present disclosure is to create a MEMS transducer and a chip with such a MEMS sound transducer with which the piezoelectric effect can be reinforced.

The task is carried out by a MEMS sound transducer and a chip having the characteristics of the disclosed subject matter.

According to the disclosure, a MEMS sound transducer is suggested to generate and/or detect sound waves in the audible wavelength spectrum. Therefore, the MEMS sound transducer is preferably developed as MEMS loudspeaker and/or MEMS microphone (i.e., at least one of a loudspeaker and microphone). The MEMS sound transducer comprises a carrier substrate with a cavity. The cavity has at least one opening, preferably two openings, developed with regard to one another especially on two opposite sides of the carrier substrate. The carrier substrate is particularly developed as a preferably closed frame. Moreover, the MEMS sound transducer comprises a multilayered piezoelectric membrane structure. In this case, the membrane structure has several layers firmly joined to one another of which at least one layer has piezoelectric properties. The membrane structure spans the cavity opening. In addition, the edge area of the membrane structure is bonded to the carrier substrate so it can be made to vibrate with respect to the carrier substrate, especially the frame, to generate and/or detect sound energy. The membrane structure comprises at least in some areas—i.e., in a top view, not necessarily stretching over its entire surface—a first and second piezo layer arranged in cross section, the latter separated from the former especially in a vertical direction. Seen from the side, the second piezo layer is preferably arranged above the first piezo layer, so that the second piezo layer is preferably located, with respect to the first piezo layer, in the area of the side of the first piezo layer that faces away from the carrier substrate.

An interlayer has been arranged between the two piezo layers. At least one of the two piezo layers can be placed tightly against the interlayer or alternately may also be separated from the interlayer by several layers. The interlayer is executed in such a way that sound energy (which had previously been reflected on a membrane structure interface developed between the membrane structure and the adjacent air owing to the acoustic impedance) can once again be reflected through the interlayer towards this interface. As a result of this, the piezoelectric effect of the membrane structure is reinforced. Consequently, the interlayer is executed so it can reflect sound energy and/or reinforce the piezoelectric effect of the membrane structure.

When sound energy is transmitted from a first medium, especially the membrane structure, to a second medium, especially the air adjacent to the membrane structure, impedance problems occur especially when the acoustic impedance of both media differs a great deal. This is the case with the membrane structure and the adjoining air. Owing to this, a part of the sound energy is reflected once again on the interface of these two media, i.e., on the interface between the membrane structure and the air adjacent to it. As a result of this, the effectiveness of the membrane structure is reduced when sound is generated and/or detected. For example, to improve sound energy transmission from the membrane structure to the air when sound is generated, the interlayer is arranged between the two piezo layers, as mentioned above. In this case, the acoustic impedance value of the interlayer with respect to at least one of the two piezo layers has been chosen in such a way that the sound energy reflected on the air interface by the interlayer is reflected back in the direction of the interface. As a result of this, higher sound energy can be transmitted to the air from the membrane structure. Advantageously, the interlayer and/or at least one of the piezo layers has/have a large impedance difference with respect to one another.

It is advantageous if the interlayer has a lower density compared to at least one of the piezo layers. As a result of this, the impedance difference between the interface and at least one of the two piezo layers can be advantageously enlarged so that more sound energy can be reflected from the interlayer.

The piezoelectric effect of the membrane structure can be reinforced especially when the interlayer is made of silicon oxide, silicon nitride and/or polysilicon. Compared to known piezo materials, these materials have a lower density to increase the sound energy reflection properties of the interlayer.

So the largest possible impedance difference between the interlayer and at least one of the two piezo layers can be accomplished, it is advantageous if at least one of the two piezo layers is made of lead zirconate titanate and/or aluminum nitride.

In an advantageous further aspect, the two piezo layers are in each case embedded between a lower and an upper electrode layer. Thus, in the cross-sectional view, the membrane structure has—starting from the carrier substrate—a first lower electrode layer, a first piezo layer, a first upper electrode layer, an interlayer, a second lower electrode layer, a second piezo layer, and a second upper electrode layer.

In order to electrically uncouple the two piezo layers with their corresponding lower and/or upper electrode layers from one another, it is advantageous if the interlayer is dielectrically executed because additional electric insulation layers can therefore be dispensed with.

To protect the membrane structure from external influences, the side of the membrane structure that faces away from the carrier substrate has been coated, at least partially, with a passivation layer.

Since the carrier substrate is made preferably of silicon and thus conducts electricity, it is advantageous if an electrical insulation layer, especially one made of silicon oxide, is arranged in the area between the carrier substance and the lowest electrode layer of the membrane structure.

Advantageously, the membrane structure comprises a membrane layer, made especially of polysilicon. The membrane structure extends preferably over the entire opening of the cavity executed in the carrier substrate. In a MEMS sound transducer executed as microphone, the membrane layer is made to vibrate by the sound energy reaching it from the outside. In a MEMS sound transducer executed as microphone, the membrane layer is made to vibrate so it can generate sound waves in the audible wavelength spectrum by means of the piezo layers that can be controlled accordingly. So that the interlayer's sound energy reflection properties are not negatively influenced, it is advantageous if the membrane layer is preferably arranged in the area below the first piezo layer—i.e., particularly between the carrier substrate and the lower first electrode layer—or in the area above the second piezo layer—i.e., especially fitting closely on the top electrode layer of the second piezo layer.

It is advantageous for the membrane structure to have several contact depressions and/or depressions executed with different depths on its side facing away from the carrier substrate. In the cross sectional view, the contact depressions extend preferably from the upper side of the membrane structure to the various electrode layers. As a result of this, the two piezo layers can be stimulated through the respective lower and upper electrode layer and/or electrical signals tapped.

For the same reason, it is advantageous if electrical connection elements are arranged in the contact depressions, preferably electrically connected to the respective electrode layer over which they extend. Additionally or alternatively, the electrical connection elements extend in the cross sectional view from the upper side area of the membrane structure over at least one of the two side walls of the contact depression all the way to their bottom.

It is also advantageous if the carrier substrate forms in the top view a frame, especially a closed one. Thus, the carrier substrate cavity has an opening on each one of the opposing sides, as a result of which the frame shape of the carrier substrate is developed.

Additionally or alternatively, it is advantageous if the membrane structure has at least one recess, especially in the interior of the frame and/or on its side facing away from the carrier substrate. In the area of this recess, at least the two piezo layers are preferably removed. Thus, in the top view, the membrane structure has at least one piezoelectrically active area and at least one passive area, developed especially by the recess. Therefore, only the active area can be piezoelectrically stimulated. Contrary to this, the passive area is merely passively movable together with the active area connected to it.

In the top view, the at least one piezoelectric active area and the at least one passive area advantageously form a pattern on the membrane structure, especially a meandering, beam-shaped, n-beam-shaped and/or spiral pattern. As a result of this, the membrane structure can execute a larger stroke in the z-direction of the MEMS sound transducer, thereby generating a higher sound pressure.

The piezoelectric active area is preferably executed to be capable of stimulating the membrane structure in a MEMS sound transducer developed as loudspeaker so it vibrates. On the other hand, the passive area (which owing to the removed piezo layers can no longer be piezoelectrically stimulated) is merely moved along over the adjacent piezoelectric active area.

It is advantageous if the recess is executed in such a way that in the top view, the piezoelectric active area has at least one anchoring end attached to the frame and/or at least one free end that can vibrate it in the z-direction with respect to the attached end. Thus, respect to the anchoring end, the free end can execute a particularly large stroke in the z-direction of the MEMS sound transducer.

To increase the stroke in the z-direction of the MEMS sound transducer, it is advantageous if the active area in the top view has one, especially beam-shaped, deflection section. Additionally or alternatively, it is advantageous if in the cross sectional view of the deflection area (in case of at least one of the two piezo layers), at least one of the two electrode layers is asymmetrically arranged opposite the corresponding piezo layer. Due to this asymmetrical arrangement of the electrode layer opposite the corresponding piezo layer, the deflection section or active area can execute a torsional movement around its longitudinal axis when tension is applied. As a result of that, the stroke of the active area can be advantageously increased in the z-direction of the MEMS sound transducer.

Furthermore, the z-stroke of the membrane structure can be increased if the active area in the top view has at least a first deflection section, a second deflection section and/or one redirecting section executed between these two. Here, the anchoring end is preferably executed on the end of the first deflection section facing away from the redirecting section and on the free end facing away from the end of the second deflection section. Owing to the redirecting section, the free end of the active area can therefore be advantageously deflected by a greater length in the z-direction of the MEMS sound transducer.

To execute the length of the active area as long as possible between its anchoring length all the way to its free end, it is advantageous if the redirecting section redirects the two deflection sections in the top view towards one another at an angle ranging from 1° to 270°, especially by 90° or 180°.

In an advantageous further aspect, the membrane structure has in the top view several transducer areas, especially ones that can be controlled separate from one another. These transducer areas of the one-piece membrane structure have preferably different sizes and/or different patterns with respect to one another. The transducer areas executed in various sizes can be made to be high- or low-pitched.

To uncouple two neighboring transducer areas at least partially from one another and/or support the one-piece membrane structure consisting of several transducer areas, it is advantageous if the carrier substrate has at least one supporting element in the top view, especially in the frame's cavity. The element is thus preferably arranged to support the membrane structure between two neighboring transducer areas. If one of the two transducer areas is stimulated to vibrate, the connecting area is supported by the supporting element between the two transducer areas, so that the transducer area contiguous to it does not vibrate or only partially. Furthermore, this prevents a very large membrane structure to be torn.

The two transducer areas adjacent to one another can be very effectively uncoupled from vibration if the supporting element is firmly attached to the membrane structure with its end facing it. However, it is alternatively also advantageous if the two transducer areas adjacent to one another are not fully uncoupled from one another. Consequently, it can likewise be advantageous if the supporting element is loosely attached to the membrane structure with its end facing it or is separated from it in the z-direction of the MEMS sound transducer.

To acoustically uncouple two adjacent transducer areas, it is advantageous for the supporting element to be executed as a wall to subdivide the cavity, preferably into at least two cavity areas.

According to other aspects, a chip—especially a silicon chip—is suggested for generating and/or detecting sound waves in the audible wavelength spectrum that has several MEMS sound transducers arranged in array-like fashion to one another and/or separately controllable from each other. At least one of these MEMS sound transducers is designed according to the preceding description, wherein the above-mentioned characteristics can be present individually or in any combination.

It is advantageous if at least two of the MEMS sound transducers have different sizes, different shapes and/or different patterns from one another.

BRIEF DESCRIPTION OF THE DRAWINGS

Additional aspects of the disclosed subject matter are described in the following embodiments, which show.

DETAILED DESCRIPTION

So that the relationships among the various elements described below can be defined, relative terms such as above, below, up, down, over, underneath, left, right, vertical and horizontal, are used for the position of the objects that the corresponding figures refer to. It goes without saying that if the position of the devices and/or elements shown in the figures changes, these terms can change. Therefore, if the orientation of the devices and/or elements shown with respect to the figures is inverted, for example, a characteristic in the subsequent figure description being specified as above can now be arranged below. Consequently, the relative terms used serve merely to facilitate the description of the relative relationships among the individual devices and/or elements described below.

Figure 1:
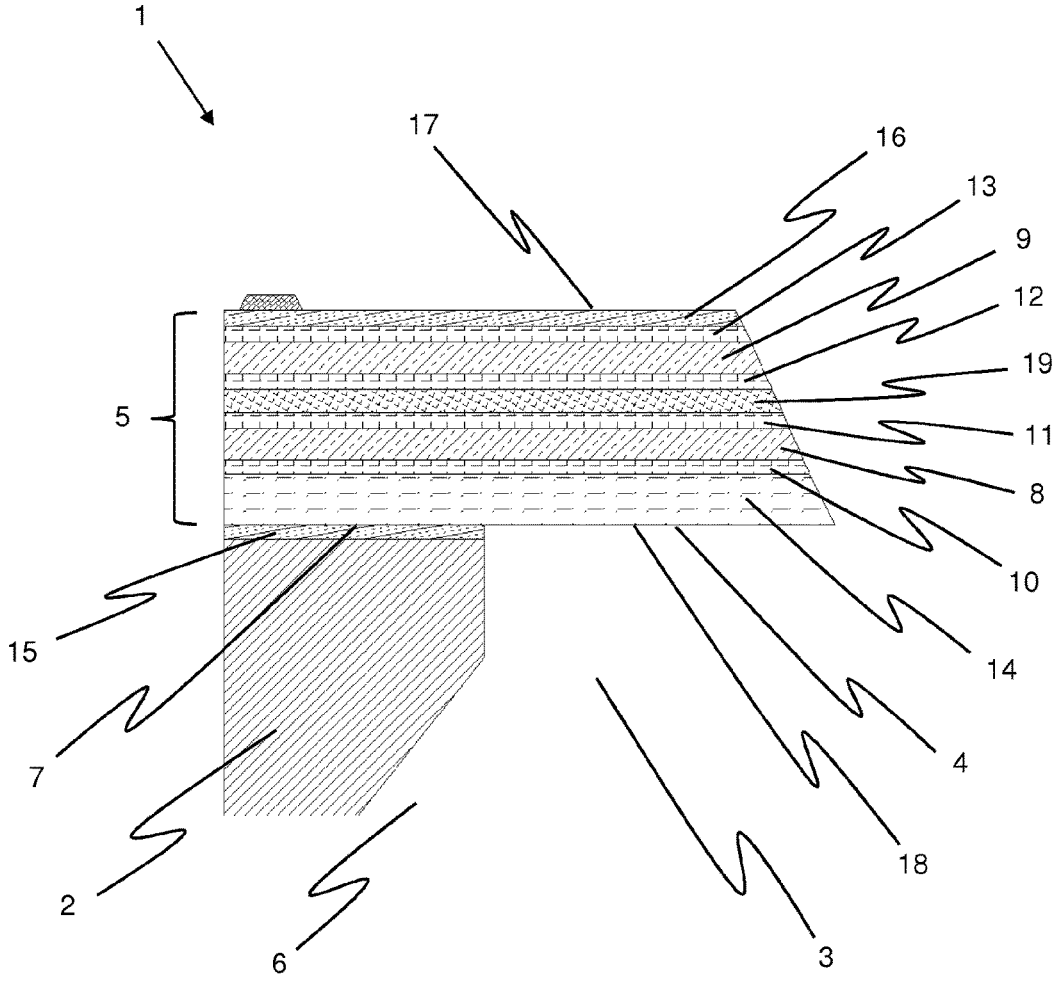
FIG. 1 is a detailed cross-sectional view of a basic embodiment of a MEMS sound transducer.

FIG. 1 shows a detailed section of a MEMS sound transducer 1 in cross section, in particular in the connecting area between a membrane structure 5 and a carrier substrate 2 of the MEMS sound transducer executed as frame. The MEMS sound transducer is executed to generate and/or detect sound waves in the audible wavelength spectrum. Thus, the MEMS sound transducer 1 is executed as MEMS loudspeaker and/or MEMS microphone (i.e., to be at least one of a sound transducer and microphone).

According to FIG. 1, the MEMS sound transducer 1 comprises a carrier substrate 2, especially made of silicon. The carrier substance 2 is executed as a frame, especially a closed one, as is the case in the embodiment shown in FIG. 2, for example. Therefore, the carrier substrate 2 comprises a hollow space or cavity 3 (shown only partially in FIG. 1). The cavity 3 comprises a first opening 4 spanned by a membrane structure 5. On its side that faces away from the membrane structure 5, the cavity 3 has a second opening 6. The cavity 3 expands at least in an area starting from the first opening 4 in the direction of the second opening 6.

According to FIG. 1, the membrane structure 5 comprises several layers firmly connected to one another. The edge area 7, of the membrane structure 5 is firmly connected to the carrier substrate 2 on the side that faces towards the carrier substrate 2. Thus, with respect to the stationary carrier substrate 2, the membrane structure 5 can vibrate in a z-direction of the MEMS sound transducer 1 to generate and/or detect sound energy, i.e., according to the orientation in vertical direction shown in FIG. 1.

To stimulate the membrane structure 5 to vibrate over a corresponding electrical control in case of a loudspeaker application and/or to convert the externally simulated vibrations of the membrane structure 5 into electrical signals in case of a microphone application, the membrane structure 5 has been executed as multilayered piezoelectric membrane structure. Consequently and according to the sectional view shown in FIG. 1, the membrane structure 5 comprises a first piezo layer 8 and a second piezo layer 9. The two piezo layers 8, 9 do not necessarily have to be executed to be continuous over the entire surface of the membrane structure 5. Alternatively, they can also have breaks, which are explained in more detail in the following embodiments.

The two piezo layers 8, 9 are made preferably of lead-zirconate-titanate (PZT) and/or aluminum nitride (ALN). So that the two piezo layers 8, 9 can detect an electrical signal in a deflection and/or to actively deflect the two piezo layers 8, 9 by applying a voltage, the two piezo layers 8, 9 are in each case embedded between two electrode layers 10, 11, 12, 13. Therefore, the first piezo layer 8 has a first lower electrode layer 10 on its side facing the carrier substrate 2, and a first upper electrode layer 11 on its side facing away from the carrier substrate 2. In the same manner, a second lower electrode layer 12 is arranged on the side of the second piezo layer 9 that faces the carrier substrate 2, and a second upper electrode layer 13 is arranged on its side facing away from the carrier substrate 2.

Moreover, according to the embodiment shown in FIG. 1, the membrane structure 5 can comprise a membrane layer 14. The membrane layer 14 gives the membrane structure 5 more stiffness and/or stability. In case of a loudspeaker application, the membrane layer 14 is stimulated to vibrate by the two piezo layers 8, 9. The membrane layer 14 is made preferably of polysilicon and/or, according to the embodiment shown in FIG. 1, is arranged below the first piezo layer 8, especially in the area between the first lower electrode layer 10 and the carrier substrate 2. Thus, the membrane layer 14 is located in the area between the carrier substrate 2 and the lower first piezo layer 8. However, in an alternative embodiment not shown here, the membrane layer 14 can also be arranged above the second piezo layer 9. Apart from the two embodiments mentioned above, it is also conceivable for the membrane structure 5 to do away completely with such a membrane layer 14.

Since the carrier substrate 2 shown in FIG. 1 is made preferably of silicon and therefore conducts electricity, it is advantageous if the carrier substrate 2 has an insulation layer 15 made especially of silicon oxide on its side facing the membrane structure 5. As a result of this, the first lower electrode layer 10 can be electrically insulated from the carrier substrate 2.

To protect the membrane structure 5 from external influences, it has on its side facing away from the carrier substrate 2 a passivation layer 16, especially a top one.

The multilayered piezoelectric membrane structure 5 described above has a first interface 17 adjacent to the surrounding air, located on the side of the membrane structure 5 facing away from the carrier substrate 2. Furthermore, the membrane structure 5 has a second interface 18 on its side facing the carrier substrate 2. Because the membrane structure 5—especially in the area of the two interfaces 17, 18—has very different impedance compared to the adjacent air, a major part of the sound energy to be transmitted is reflected on the interface 17, 18 and this reduces the piezoelectric effect of the MEMS sound transducer 1.

Thus, in a loudspeaker application, for example, the membrane structure 5 is first made to vibrate via an electrical stimulation of the two piezo layers 8, 9 in the z-direction. In this case, a sound wave is generated on the first interface 17 in the audible wavelength spectrum. However, sound energy generating the sound wave is not transferred completely to the air. Instead, owing to the large impedance difference between the membrane structure 5 and the adjacent air, a part of the sound energy is reflected once again back on the first interface 17, i.e., towards the carrier substrate 2. In a membrane structure 5 known from the state of the art, this sound energy is lost, thereby reducing the piezoelectric effect of the membrane structure 5.

To prevent this, the membrane structure 5 has therefore an interlayer 19 to reflect sound energy according to FIG. 1. The interlayer 19 is arranged between the two piezo layers 8, 9 according to the sectional view shown in FIG. 1. Here, the interlayer 19 is placed directly against the first upper electrode layer 11 and the second lower electrode layer 12.

Compared to at least one of the two piezo layers 8, 9, the interlayer 19 has a lower density. Consequently, the interlayer 19 and at least one of the two piezo layers 8, 9 have different impedance compared to one another. Owing to this impedance difference, the interlayer 19 acts to reflect sound energy. As a result of this and taking the loudspeaker application as an example, the sound energy partially reflected back on the first interface 17 is once again reflected towards the first interface 17 by the interlayer 19. Consequently, this sound energy is not lost but is used once again on the interface 17 to generate a sound wave and this amplifies the piezoelectric effect of the membrane structure 5. The sound energy reflecting properties of the interlayer 19 are especially well-developed if the interlayer 19 is made of silicon oxide, silicon nitride and/or polysilicon. Analogously, the interlayer 19 has an effect on a MEMS sound transducer 1 acting as a microphone.

The interlayer 19 is not only executed to reflect sound but also to be dielectric. As a result of this, the first upper electrode layer 11 and the second lower electrode layer 12 are electrically insulated from one another and this advantageously saves additional insulation layers.

Different embodiments of the MEMS sound transducer 1 are shown in FIGS. 2, 3, 4 and 5. According to the detailed section of the membrane structure 5 shown in FIG. 1, every one of these embodiments has two piezo layers 8, 9 separated from one another in the z-direction, arranged in each case sandwich-like between two electrode layers 10, 11, 12, 13. Furthermore, an identically designed and identically acting interlayer 19 has been arranged between these two piezo layers 8, 9. The above-mentioned layer combination constitutes the basis for the embodiments described below. In the following description of these embodiments, and compared to the embodiment shown in FIG. 1, the same reference characters are used for the same characteristics. As far as they are not explained in detail once again, their design and mode of action correspond to the characteristics that have already been described above.

Figure 2:
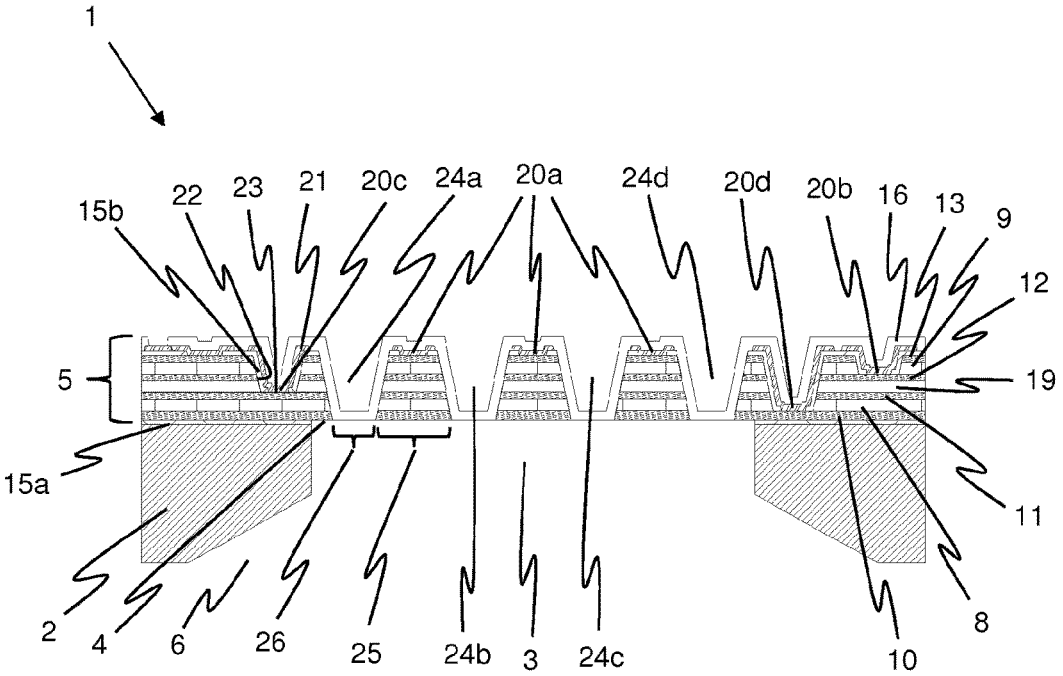
FIG. 2 is a cross-sectional view of a second embodiment of a MEMS sound transducer with a passivation layer acting as membrane layer.

According to the embodiment shown in FIG. 2, the membrane structure 5 has no separate membrane layer 14. Instead, the passivation layer 16 takes over its action and thus acts as membrane layer 14. The passivation layer 16 extends in horizontal direction over the entire first opening 4.

To actively control the two piezo layers 8, 9 via the correspondingly assigned electrode layers 10, 11, 12, 13 in case of a loudspeaker application and/or to tap the electrical signals generated by the two piezo layers 8, 9 in case of a microphone application, the membrane structure 5 has according to FIG. 2 several contact depressions 20*a*, 20*b*, 20*c*, 20*d* on its side facing away from the carrier substrate 2. The contact depressions 20*a*, 20*b*, 20*c*, 20*d* extend in each case from the side of the membrane structure 5 facing away from the carrier substrate 2 all the way to one of the electrode layers 10, 11, 12, 13. In each one of the contact depressions 20*a*, 20*b*, 20*c*, 20*d*, an electrical connection element 21, especially an electric contact, has been arranged. To preserve clarity, in the connection element 21 in the embodiment shown in FIG. 2 only one of the contact depressions 20*a*, 20*b*, 20*c*, 20*d* has been provided with a reference character.

The connection elements 21 are in each case electrically connected to the electrode layer 10, 11, 12, 13 assigned to them. According to the cross-sectional view shown in FIG. 2, the connection elements 21 extend in each case from the upper side area of the membrane structure 5 over the side walls 22 of the corresponding contact depressions 20*a*, 20*b*, 20*c*, 20*d* until their bottom. To ensure that the respective connection elements 21 are exclusively electrically connected to a single one of the electrode layers 10, 11, 12, 13, an additional insulation layer 15*b* has been arranged in the area between the connection element 21 and the side wall 22.

To improve the maximum stroke of the membrane structure 5 in the z-direction, the membrane structure 5 has several recesses 24*a*, 24*b*, 24*c*, 24*d*. The recesses 24*a*, 24*b*, 24*c*, 24*d* extend from the upper side of the membrane structure 5 towards the carrier substrate 2. In the area of the recesses 24*a*, 24*b*, 24*c*, 24*d*, the two piezo layers 8, 9 have been removed. Therefore, the membrane structure 5 has piezoelectrically active areas 25—in which the two piezo layers 8, 9 are still present—and passive piezoelectric areas—in which the two piezo layers 8, 9 have been removed—(cf. also FIGS. 7 and 8). To preserve clarity, in each case only one of these active areas 25 and passive areas 26 is indicated with a reference character in the embodiment shown in FIG. 2.

According to the embodiment shown in FIG. 2, the two piezo layers 8, 9, the interlayer 19 and all electrode layers 10, 11, 12, 13 have been removed. Thus, in the area of the respective passive areas 26, the membrane structure 5 has only the passivation layer 16. Consequently, the passivation layer 16 acts as membrane layer 14.

Figure 3:
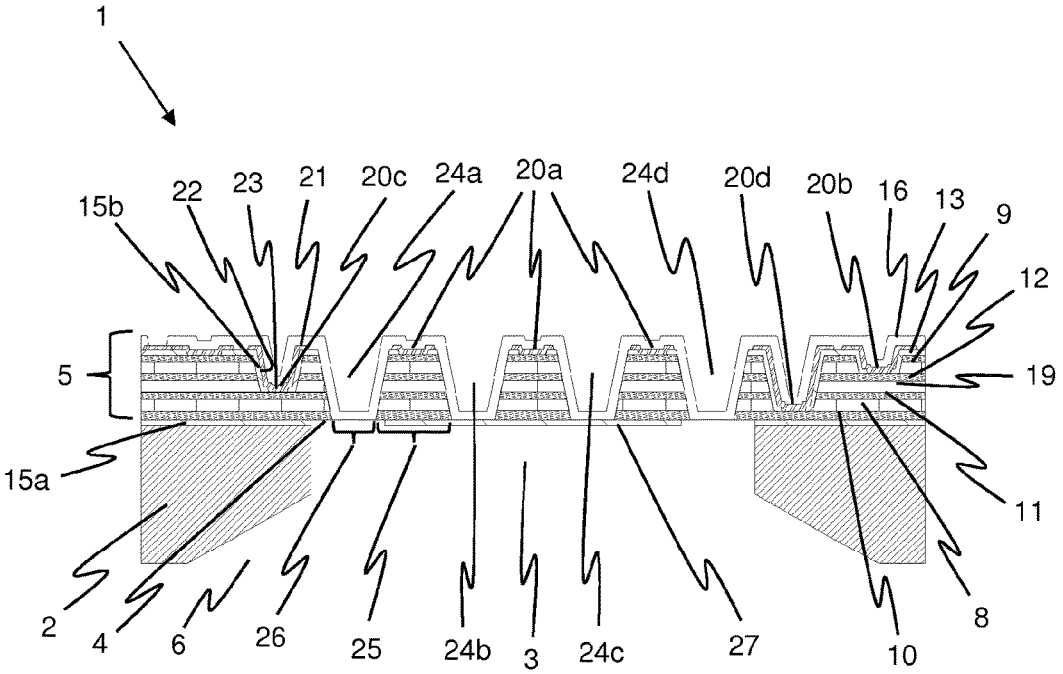
FIG. 3 is a cross-sectional view of a third embodiment of a MEMS sound transducer with a reinforcement layer that is executed from a lower insulation layer and/or extending only partially over an opening of the carrier substrate in vertical direction.

The embodiment shown in FIG. 3 differs from the embodiment described above in that the membrane structure 5 has a reinforcement layer 27 in the area of the first opening 4. For this, the first insulation layer 15*a* has not been fully removed in the area of the first opening 4. According to the cross sectional view shown in FIG. 3, it extends horizontally over several (especially overall) active areas 25 and several passive areas 26 (especially over the two inner ones). However, the edge area of the reinforcement layer 27 close to the carrier substrate has been removed. Thus, the reinforcement layer 27 has a separation (particularly executed as frame) in a horizontal direction towards the carrier substrate 2. The separation is at least executed in such a way that at least one of the passive areas 26 is executed without this reinforcement layer 27 in the edge area. Thus, the insulation layer 15*a* arranged in the interior of the carrier substrate 2 executed as frame acts as reinforcement layer 27. In the area of the reinforcement layer 27, the membrane structure 7 is more stable and/or rigid. Contrary to this, the membrane structure 5 is softer and/or more flexible in its edge area executed without this reinforcement layer 27.

Figure 4:
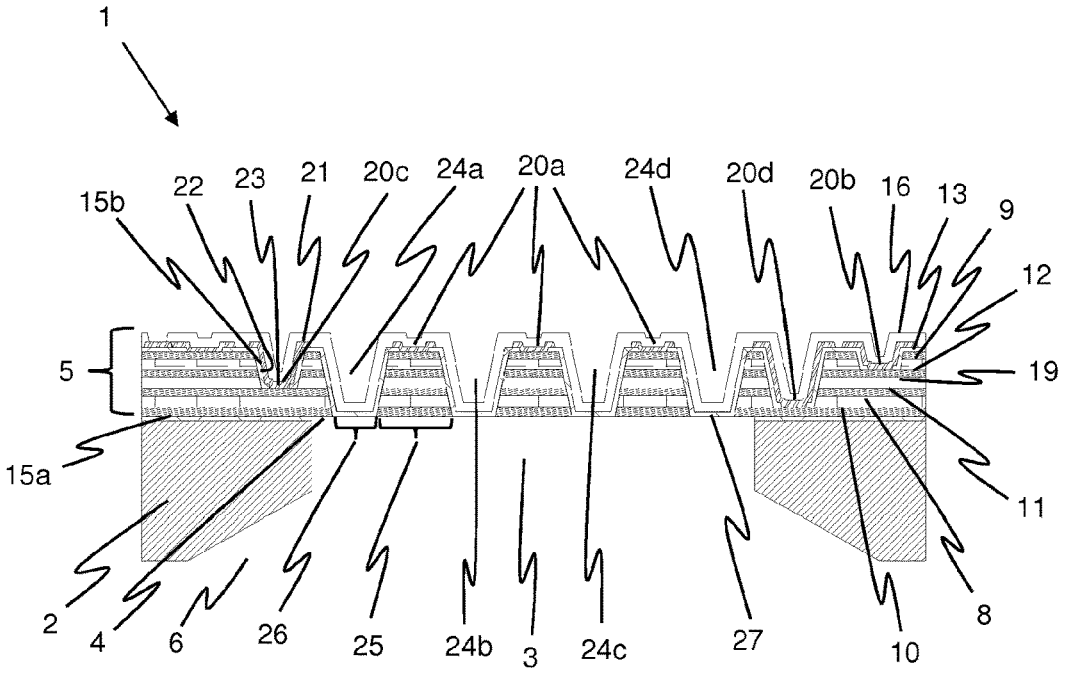
FIG. 4 is cross-sectional view of a fourth embodiment of a MEMS sound transducer with a reinforcement layer that is executed from an upper insulation layer and/or extending over the entire opening of the cavity in a vertical direction.

Alternately, according to the embodiment shown in FIG. 4, the reinforcement layer 27 can also be executed by means of the second insulation layer 15*b*. Here, the reinforcement layer 27 or second insulation layer 15*b* extends in horizontal direction over the entire width of the first opening 4.

Figure 5:
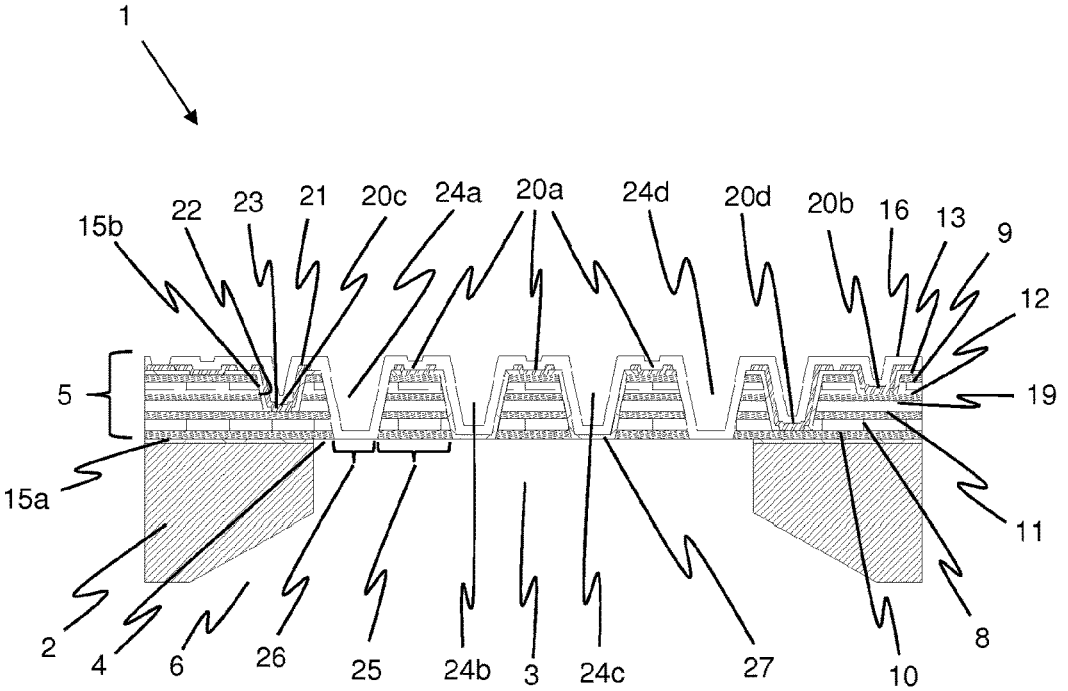
FIG. 5 is a cross-sectional view of a fifth embodiment of a MEMS sound transducer with a reinforcement layer that is executed from an upper insulation layer and/or extending only partially over the opening of the cavity in a vertical direction.
Figure 6A:
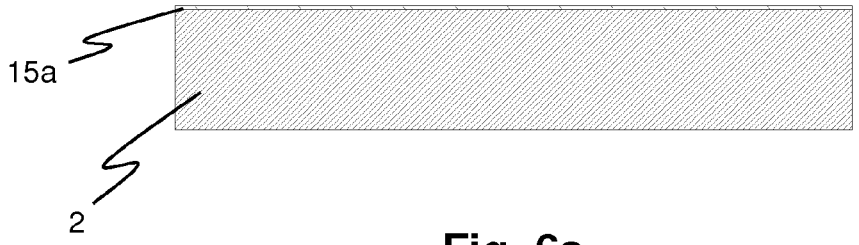
FIGS. 6*a*-6*f* show the individual process steps to manufacture a MEMS sound transducer of the fifth embodiment shown in FIG. 5.
Figure 6B:
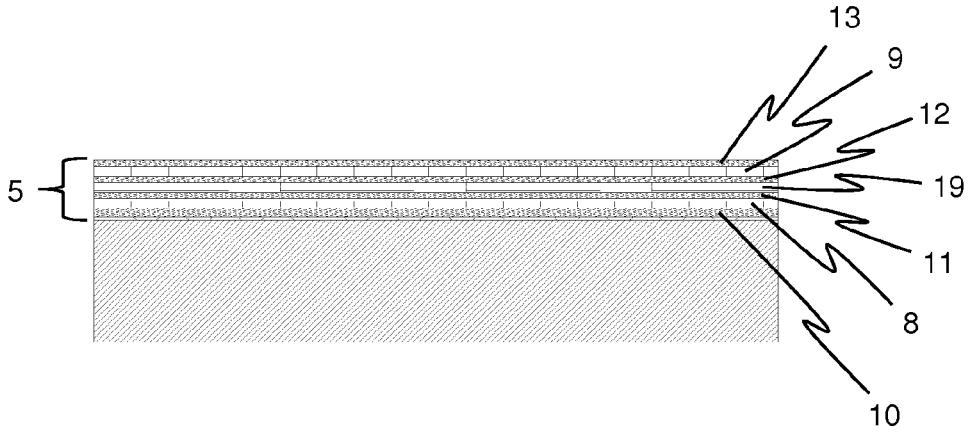
Figure 6C:
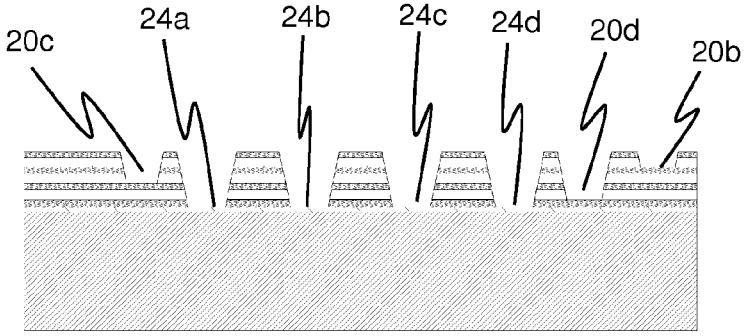
Figure 6D:
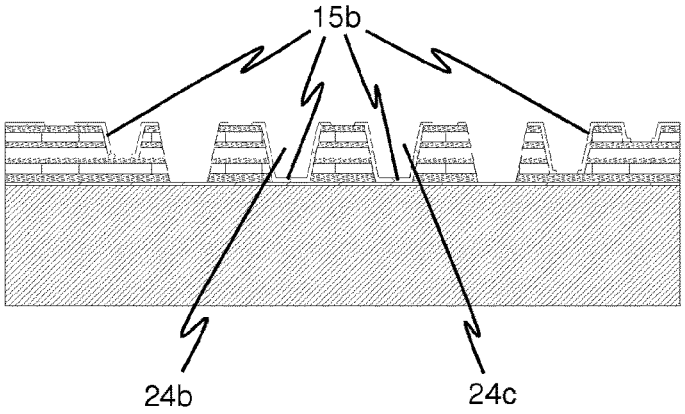
Figure 6E:
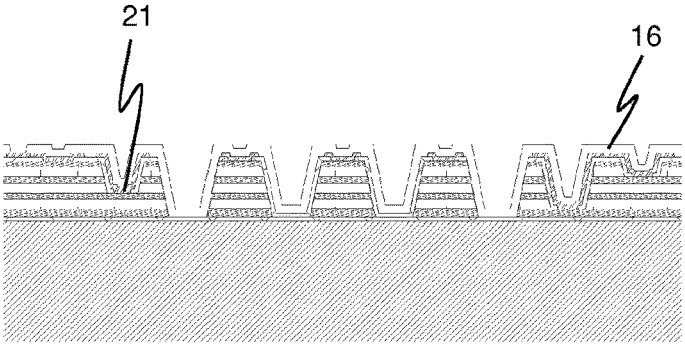
Figure 6F:
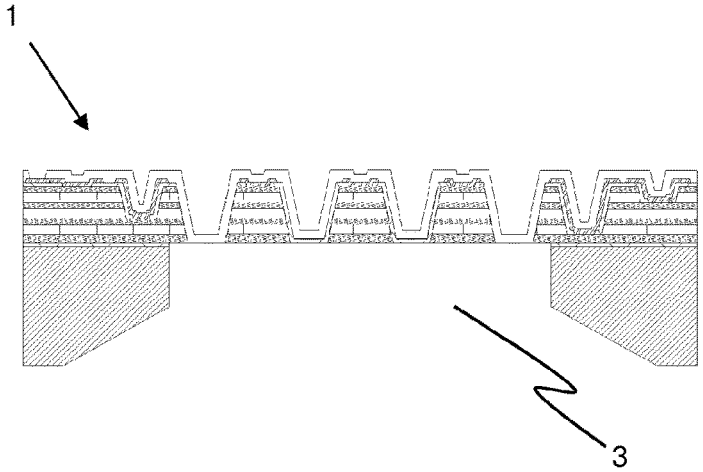

However, in a second alternative embodiment according to FIG. 5, the second insulation layer 15*b* acting as reinforcement layer 27 can also be separated in the edge area—comparable to the embodiment shown in FIG. 3. As a result of this, the membrane structure 5 is stiffer and/or more stable only in the inner area owing to the action of the reinforcement layer 27. Compared to this, the edge area adjacent to the carrier substrate 2 has been executed in a more flexible and/or softer way, since it has no reinforcement layer 27 or second insulation layer 15*b*.

FIGS. 6*a* to 6*f* illustrate the manufacturing process of the MEMS sound transducer 1 in the embodiment shown in FIG. 5. In this case and according to FIG. 6*a*, first of all a carrier substrate 2 made of silicon is prepared with an insulation layer 15*a* arranged on the upper side. Afterwards, according to FIG. 6*b*, the membrane structure 5 is placed on the upper side of the insulation layer 15*a*. In this case, to start, the first lower electrode layer 10, the first piezo layer 8, the first upper electrode layer 11, the interlayer 19, the second lower electrode layer 12, the second piezo layer 9 and the second upper electrode layer 13 are preferably applied one after another. According to FIG. 6*c*, in an ensuing process step, the contact depressions 20*b*, 20*c*, 20*d* and the recesses 24*a*, 24*b*, 24*c*, 24*d* are introduced into the membrane structure 5 from the side facing away from the carrier substrate 2. Afterwards, according to FIG. 6*d*, the second insulation layer 15*b* is applied on the contact recesses 20*b*, 20*c*, 20*d* and the two inner recesses 24*b*, 24*c*. After the contact depressions 20*a*, 20*b*, 20*c*, 20*d* have been provided with the respective connection elements 21, the entire membrane structure 5 is covered with the passivation layer 16 according to FIG. 6*e*. In the last step of the process shown on FIG. 6*f*, the cavity 3 is executed from the underside, so that the carrier substrate 2 is now frame-shaped and the membrane structure 5 is capable of vibrating in the z-direction with respect to the frame.

Figure 7:
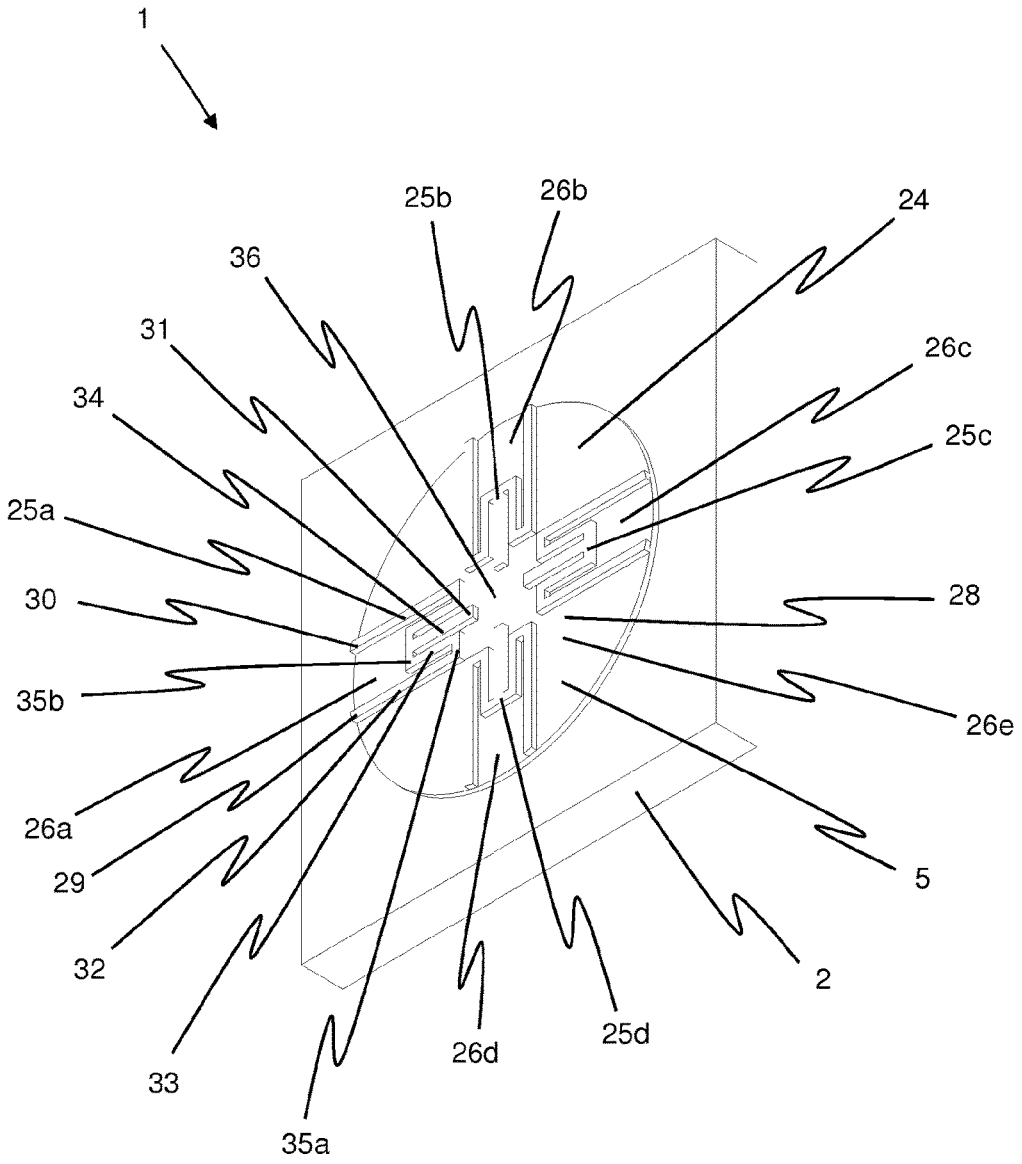
FIGS. 7 & 8 are perspective views of two different embodiments of a MEMS sound transducer.
Figure 8:
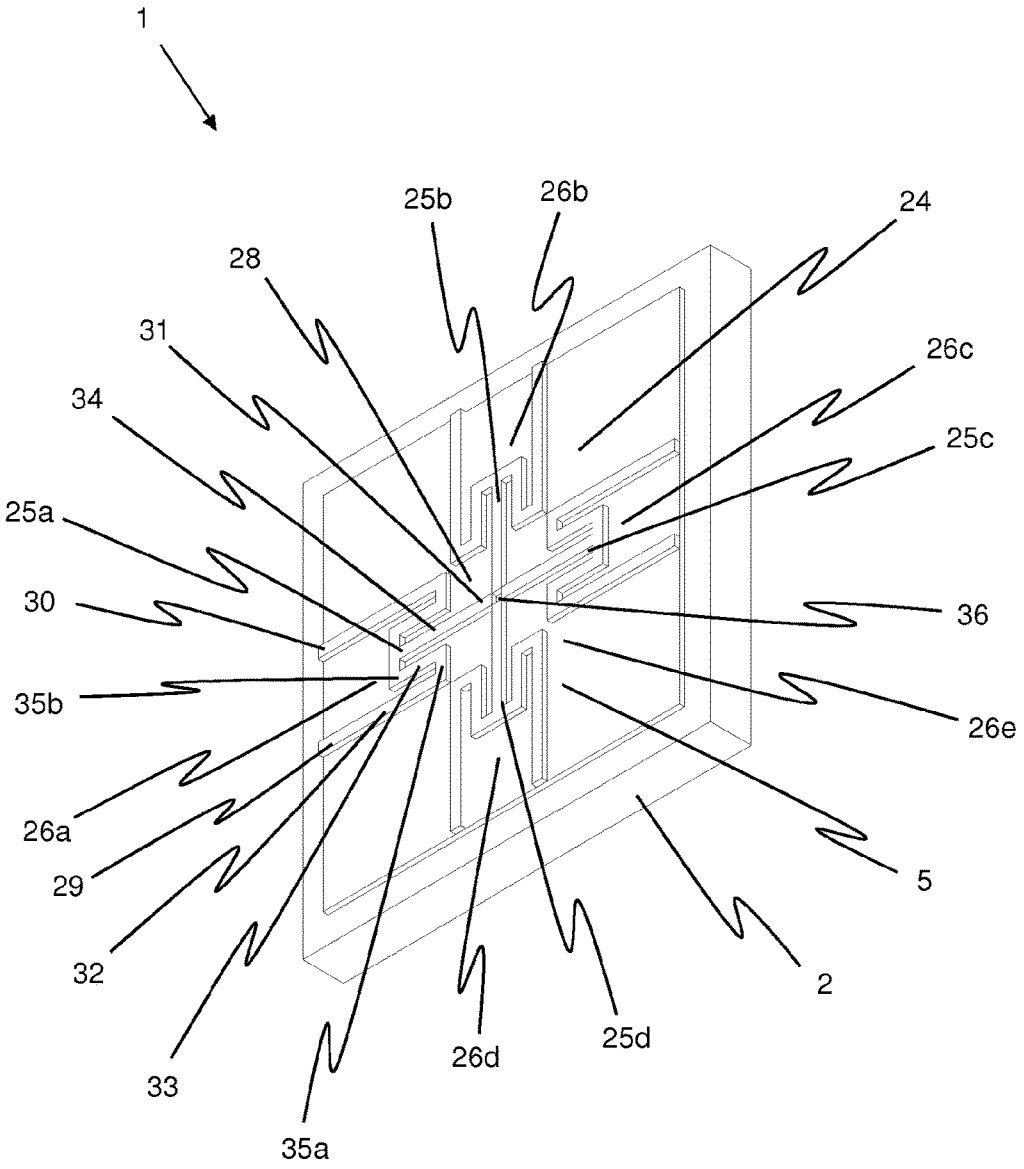

A perspective view of two different embodiments of the MEMS sound transducer 1 is shown in FIGS. 7 & 8. The hollow space or cavity 3 is on the backside of the MEMS sound transducer 1 and cannot therefore be seen in this perspective view shown in FIGS. 7 & 8.

According to the embodiment shown in FIG. 7, the membrane structure 5 and/or the cavity 3 not visible here has/have a circular shape in the top view. Furthermore, it can be recognized in the perspective view that the recesses 24—from which merely one has been provided with a reference character to preserve clarity—form a pattern 28. The pattern 28 is formed by the piezoelectrically active areas 25*a*, 25*b*, 25*c*, 25*d* and the piezoelectrically passive areas 26*a*, 26*b*, 26*c*, 26*d*, 26*e*.

One of these active areas 25*a* will be explained in more detail now. According to FIG. 7, the active area 25*a* has a rigid and/or firmly clamped first and second anchoring end 29, 30 connected to the frame or the carrier substrate 2. Furthermore, the active area 25*a* comprises a free end 31 being deflectable in the z-direction with respect to the two anchoring ends 29, 30. In the area between the respective anchoring end 29, 30 and the free end 31, the active area 25*a* is largely meander-shaped, at least in some areas.

Consequently, the active area 25*a* has a corresponding first deflection section 32, a corresponding second deflection section 33 (although only one of these two has been provided with a reference character) and a common third deflection area 34 starting from the respective anchoring end 29, 30. The deflection areas 32, 33, 34 are executed with a beam shape in the two embodiments shown in FIGS. 7 & 8. Two of the deflection sections 32, 33, 34 adjacent to one another are in each case connected to one other via a redirecting section 35*a*, 35*b*. In this embodiment, each redirecting section 35*a*, 35*b*, redirects the two deflection sections 32, 33, 34 adjacent to one another by 180°. Through this redirecting connection of these individual deflection sections 32, 33, 34—namely with the help of the redirecting section 35*a*, 35*b*—it is possible to increase the maximum stroke of the active area 25*a* in the z-direction of the MEMS sound transducer 1.

According to the embodiment shown in FIG. 7, when seen from the top, the free ends 31 of the active areas 25*a*, 25*b*, 25*c*, 25*d* are separated from one another and from a central spot 36 located in the middle.

FIG. 8 shows a perspective view of an alternative embodiment of the MEMS sound transducer 1 wherein the same names were used for the same characteristics compared to the embodiment of FIG. 7 described above. Unless they are not explained in detail once again, their design and mode of action correspond to the characteristics already explained.

According to the embodiment shown in FIG. 8, the membrane structure 5 has not been executed in a circular shape but a square one, unlike the embodiment shown in FIG. 7. Moreover, the free ends 31 of the corresponding active areas 25*a*, 25*b*, 25*c*, 25*d* lie directly next to one another in the central spot 36. Additionally or alternatively, however, the free ends 31 can also be attached to one another and/or be executed as one piece.

Figure 9:
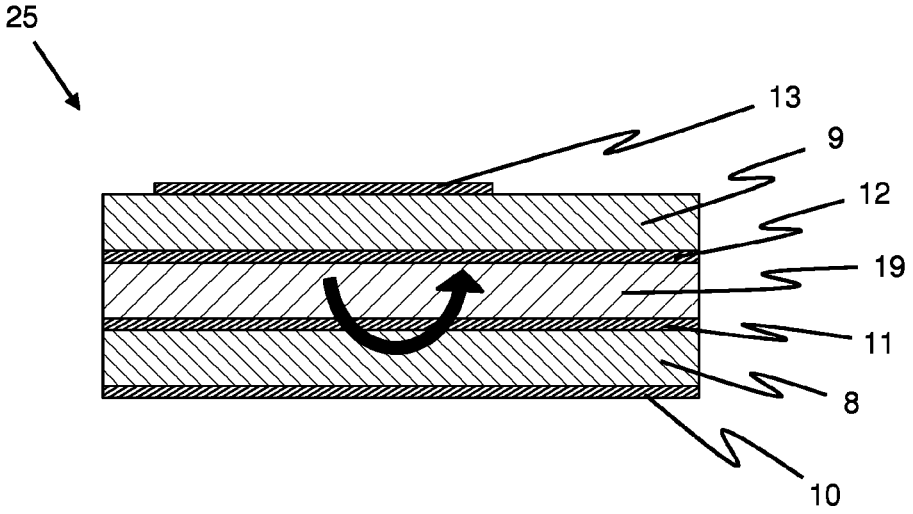
FIG. 9 is a cross-sectional view through an active area of the embodiments shown in FIGS. 7 and/or 8.

FIG. 9 shows a cross-section through an active area 25, especially through a beam-shaped deflection section 32, 33, 34 and/or redirecting section 35*a*, 35*b* of one of the embodiments shown in FIGS. 7 and/or 8. Here, the second upper electrode layer 13 is asymmetrically arranged with respect to the second piezo layer 9. As a result of that, the active area 25 executes a torsional movement around its longitudinal axis, and as a result of this the maximum stroke height of the MEMS sound transducer can be increased in the z-direction. This torsion is indicated with an arrow in FIG. 9. Additionally or alternatively, more or all electrode layers 10, 11, 12, 13 can also be asymmetrically arranged with respect to their respectively assigned piezo layer 8, 9.

Figure 10:
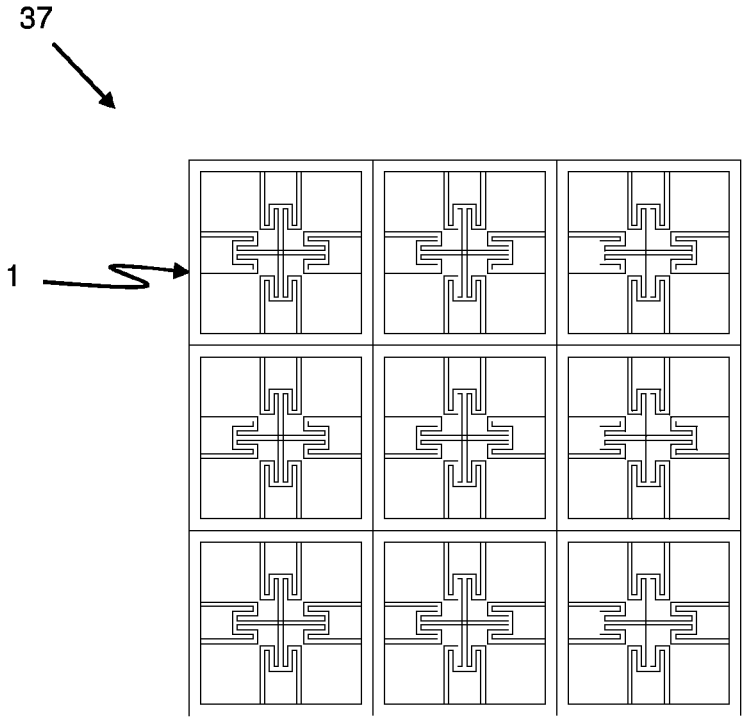
FIG. 10 is a top view of several MEMS sound transducers arranged in array-like fashion relative to one another according to the embodiment shown in FIG. 8.

According to FIG. 10, MEMS sound transducers 1 can be arranged in an array 37. As shown in the embodiment of FIG. 10, all MEMS sound transducers 1 have the same shape and size. Furthermore, their active area 25 has in each case the same pattern 28. In an alternative embodiment not shown here, these MEMS sound transducers 1 arranged in array-like fashion to one another can also have different sizes compared to each other. As a result of this, high- and low-pitched tones can be created. Moreover, the MEMS sound transducers 1 can have different patterns 28 and membrane structure shapes compared to one another.

Figure 11:
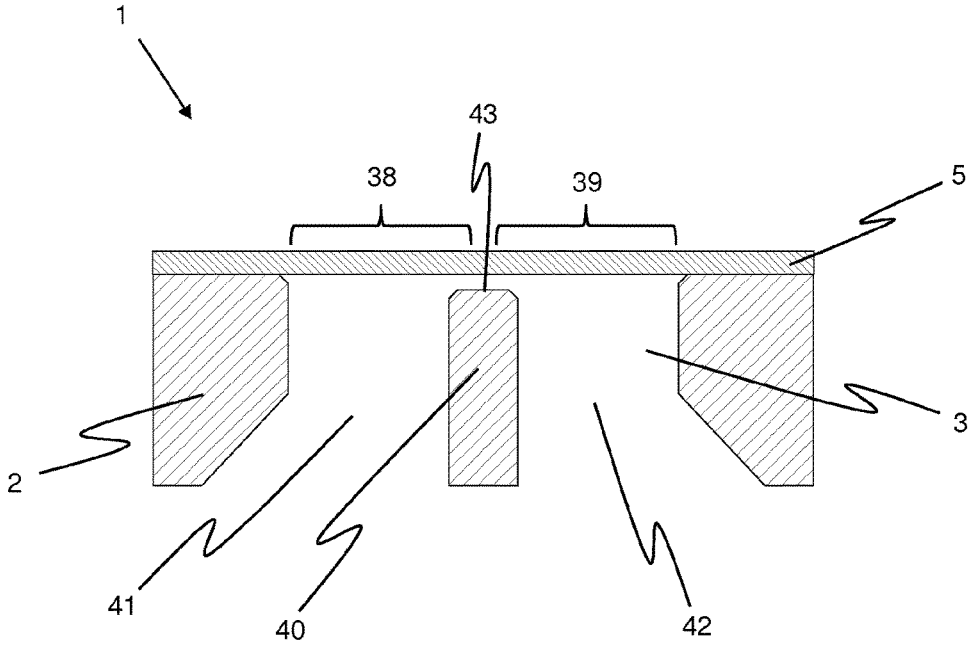
FIG. 11 is a cross-sectional view of another embodiment of a MEMS sound transducer with a one-piece membrane structure that has several transducer areas supported by at least one supporting element in the z-direction.

According to the embodiment shown in FIG. 11, the MEMS sound transducer 1 has at least two transducer areas 38, 39—especially separately controllable from one another—the transducer areas 38, 39 of the one-piece membrane structure 5 can be executed in different sizes and/or have different patterns. To protect the membrane structure 5 from overloads, the MEMS sound transducer 1 has at least one supporting element 40 in the interior of the frame or carrier substrate 2. The supporting element 40 is executed as a wall and partitions the cavity 3 in a first and second cavity area 41, 42. According to the present embodiment, the supporting element 40 can be separated from the membrane structure 5 in the z-direction with the supporting element end 43 facing it. However, it is likewise alternatively conceivable for the supporting element 40 to fit closely on the underside of the membrane structure 5 with its support element end 43 and/or be firmly attached to it.

In an embodiment not shown here, the MEMS sound transducer 1 shown in FIG. 11 (which has several transducer areas 38, 39) can also be arranged with more identical or differently executed MEMS sound transducers 1 in array-like fashion within the meaning of the embodiment shown in FIG. 10.

The present invention is not restricted to the embodiments shown and described. Deviations within the framework of the patent claims are just as possible as a combination of the characteristics, even if they are shown and described in different embodiments.

The invention claimed is:

1. A MEMS loudspeaker for generating sound waves in air in an audible wavelength spectrum, the MEMS loudspeaker comprising:

a carrier substrate configured as a frame, a cavity defined within an interior of the frame of the carrier substrate, the cavity defining at least one opening, a multilayered piezoelectric structure spanning over the opening of the cavity and having an edge area connected with the carrier substrate so that with respect to the carrier substrate the multilayered piezoelectric structure is capable of vibrating to at least one of generate and detect sound energy, wherein the multilayered piezoelectric structure has a membrane layer supporting other portions of the multilayered piezoelectric structure, and in-cross-section at least in some areas a first piezo layer and a second piezo layer spaced from the first piezo layer, the membrane layer configured for being stimulated to vibrate by the first piezo layer and the second piezo layer, the multilayered piezoelectric structure having several transducer areas separately controllable from one another and dissimilarly shaped from one another, at least one supporting element in the interior of the frame arranged to support the multilayered piezoelectric structure, the at least one supporting element having an end attached to multilayered piezoelectric structure generally between the two transducer areas, and an interlayer arranged in an area between the first and second piezo layers, the interlayer being configured so that sound energy can be reflected in the direction of at least one interface of the multilayered piezoelectric structure adjacent to the air.

2. A MEMS loudspeaker according claim 1, wherein the interlayer has lower density than at least one of the first and second piezo layers.

3. A MEMS loudspeaker according to claim 1, wherein at least one of the first and second piezo layers includes at least one of lead-zirconate-titanate and aluminum nitride.

4. A MEMS loudspeaker according to claim 1, wherein each of the first and second piezo layers are embedded between a lower and an upper electrode layer, the interlayer sitting tightly directly on the upper electrode layer of the first piezo layer and on the lower electrode layer of the second piezo layer.

5. A MEMS loudspeaker according to claim 1, wherein the membrane layer includes polysilicon.

6. A MEMS loudspeaker according to claim 5, wherein the membrane layer is located in one of below the first piezo layer and above the second piezo layer.

7. A MEMS loudspeaker according to claim 1, wherein the multilayered piezoelectric structure has at least one recess within which at least a portion of each of the first and second piezo layers has been removed, so that when seen from the top, the multilayered piezoelectric structure has at least one piezoelectrically active area and at least one passive area created by the recess that form a pattern relative to one another.

8. A MEMS loudspeaker according to claim 7, wherein the recess is configured so that the at least one piezoelectrically active area has at least one anchoring end attached to the frame in the top view and has at least one free end that can vibrate in a z-direction relative to the at least one anchoring end.

9. A MEMS loudspeaker according to claim 8, wherein the active area has in the top view at least one deflection section.

10. A MEMS loudspeaker according to claim 8, wherein the active area in the top view has at least one first deflection section.

11. A MEMS loudspeaker according to claim 10, wherein the active area in the top view also has at least one of a second deflection section and a redirection section between the first deflection section and the second deflection section.

12. A MEMS loudspeaker according to claim 8, wherein in a sectional view, in at least one of the first and second piezo layers, at least one of the two electrode layers is asymmetrically arranged with respect to the respective at least one of the first and second piezo layers.

13. A MEMS loudspeaker according to claim 7, wherein the at least one recess is disposed on a side of the multilayered piezoelectric structure facing away from the carrier substrate.

14. A MEMS loudspeaker according to claim 1, wherein the at least one supporting element is configured as a wall and partitions the cavity into at least two cavity areas.

15. A chip for of generating sound waves in air in an audible wavelength spectrum, the chip comprising a plurality of MEMS sound transducers arranged in an array on the chip, at least one of the plurality of MEMS sound transducers being a MEMS loudspeaker as recited in claim 1.

16. A MEMS loudspeaker according to claim 1, wherein the interlayer is dielectric.

17. A chip for generating sound waves in air in an the audible wavelength spectrum, the chip comprising a plurality of MEMS sound transducers that are separately controllable from one another on the chip, at least one of the plurality of MEMS sound transducers being a MEMS loudspeaker as recited in claim 1.

18. A MEMS loudspeaker according to claim 1, wherein the membrane layer is located closer to the carrier substrate than the first piezo layer.

19. A MEMS loudspeaker according to claim 1, wherein the interlayer is made of at least one of silicon oxide, silicon nitride and polysilicon.

* * * * *